US009759218B2

(12) United States Patent
Creager et al.

(10) Patent No.: US 9,759,218 B2
(45) Date of Patent: Sep. 12, 2017

(54) SUPERCHARGER WITH SUN GEAR AND PLANETARY GEARS

(71) Applicant: Eaton Corporation, Cleveland, OH (US)

(72) Inventors: Christopher W. Creager, Ypsilanti, MI (US); Daniel R. Ouwenga, Portage, MI (US); Christopher Suhocki, Battle Creek, MI (US)

(73) Assignee: Eaton Corporation, Cleveland, OH (US)

( * ) Notice: Subject to any disclaimer, the term of this patent is extended or adjusted under 35 U.S.C. 154(b) by 291 days.

(21) Appl. No.: 14/211,519

(22) Filed: Mar. 14, 2014

(65) Prior Publication Data

US 2014/0271136 A1 Sep. 18, 2014

Related U.S. Application Data

(60) Provisional application No. 61/785,640, filed on Mar. 14, 2013.

(51) Int. Cl.

| | |
|---|---|
| ***F04C 29/00*** | (2006.01) |
| ***F04C 18/12*** | (2006.01) |
| ***F04D 17/10*** | (2006.01) |
| ***F02B 39/10*** | (2006.01) |
| ***F02B 39/04*** | (2006.01) |

(52) U.S. Cl.

CPC ..... *F04D 17/10* (2013.01); *F02B 39/04* (2013.01); *F02B 39/10* (2013.01); *F04C 18/12* (2013.01); *F04C 29/005* (2013.01); *F04C 2240/50* (2013.01)

(58) Field of Classification Search

CPC ..... F04C 29/005; F16H 57/08; F02B 39/04

See application file for complete search history.

(56) References Cited

U.S. PATENT DOCUMENTS 3,473,437 A * 10/1969 Ohrberg ..... F04C 2/104 418/149
4,610,182 A * 9/1986 Heidrich ..... F04D 13/028 60/796
5,879,259 A 3/1999 Teraoka et al.

(Continued)

FOREIGN PATENT DOCUMENTS

CN 102352791 2/2012
DE 2926426 1/1981

(Continued)

*Primary Examiner* — Mary A Davis

(74) *Attorney, Agent, or Firm* — Dierker & Kavanaugh, P.C.

(57) ABSTRACT

A supercharger includes a supercharger housing, a primary rotor having a primary rotor shaft fixed to rotate therewith. A ring gear with internal teeth is attached to a transmission housing portion of the supercharger housing. A sun gear is fixed to the primary rotor shaft. A planetary gear carrier has a plurality of planetary gear shafts. A plurality of planetary gears rotate about corresponding planetary gear shafts and are meshingly engaged with the sun gear and the ring gear and are substantially equally spaced about the sun gear. A rotatable input shaft is connectable to the planetary gear carrier. The input shaft is connectable to receive rotational motion and power from an engine.

26 Claims, 3 Drawing Sheets

(56) References Cited

U.S. PATENT DOCUMENTS

| | | | | |
|---|---|---|---|---|
| 6,092,511 | A * | 7/2000 | Middlebrook | F02B 39/04 123/559.1 |
| 9,127,690 | B2 * | 9/2015 | Knaack | F01D 25/28 |
| 2002/0096156 | A1 * | 7/2002 | Palazzolo | F02B 39/04 123/559.1 |
| 2011/0110802 | A1 * | 5/2011 | Schmitz | F04C 29/025 417/374 |

FOREIGN PATENT DOCUMENTS

| | | |
|---|---|---|
| DE | 102004016327 | 11/2005 |
| EP | 2357319 | 8/2011 |
| GB | 579043 | 7/1946 |

* cited by examiner

SUPERCHARGER WITH SUN GEAR AND PLANETARY GEARS

CROSS-REFERENCE TO RELATED APPLICATIONS

This application claims the benefit of U.S. Provisional Application Ser. No. 61/785,640, filed Mar. 14, 2013, which is incorporated by reference herein in its entirety.

BACKGROUND

Superchargers may be used to increase or "boost" the air pressure in the intake manifold of an internal combustion (IC) engine to increase the horsepower output of the IC engine. The IC engine may thus have an increased horsepower output capability than would otherwise occur if the engine were normally aspirated (e.g., the piston would draw air into the cylinder during the intake stroke of the piston). A conventional supercharger is generally mechanically driven by the engine, and therefore, may represent a drain on engine horsepower whenever engine "boost" may not be required and/or desired. A selectively engageable clutch may be disposed in series between the supercharger input (e.g., a belt driven pulley) and the rotors of the supercharger. A transmission may be disposed in series between the clutch and the rotors of the supercharger.

SUMMARY

A supercharger includes a supercharger housing, and a primary rotor having a primary rotor shaft fixed to rotate therewith. A ring gear with internal teeth is attached to a transmission housing portion of the supercharger housing. A sun gear is fixed to the primary rotor shaft. A planetary gear carrier has a plurality of planetary gear shafts. A plurality of planetary gears rotate about corresponding planetary gear shafts and are meshingly engaged with the sun gear and the ring gear and are substantially equally spaced about the sun gear. A rotatable input shaft is connectable to the planetary gear carrier. The input shaft is connectable to receive rotational motion and power from an engine.

BRIEF DESCRIPTION OF THE DRAWINGS

Features and advantages of examples of the present disclosure will become apparent by reference to the following detailed description and drawings, in which like reference numerals correspond to similar, though perhaps not identical, components. For the sake of brevity, reference numerals or features having a previously described function may or may not be described in conjunction with other drawings in which they appear.

DETAILED DESCRIPTION

The present disclosure relates generally to superchargers. Superchargers according to the present disclosure may be of various types. For example, a fixed displacement supercharger such as the Roots-type functions as a pump outputting a fixed volume of air per rotation. Compression of the air delivered by the Roots-type supercharger takes place downstream of the supercharger by increasing the mass of air in a fixed volume of the engine intake manifold. Another example of a supercharger is a compressor, such as a centrifugal-type supercharger that compresses the air as it passes through the supercharger. In the centrifugal-type supercharger, the pressure of air delivered to the engine is dependent on compressor speed.

Some engines, e.g., diesel engines, may have a relatively slow turning crankshaft and may have a relatively small diameter crankshaft pulley (e.g., about 152 mm, i.e., about 6 inches). In examples of the present disclosure, the supercharger may be driven by a belt connected from a crankshaft pulley to a drive-pulley connected to a pulley/input shaft of the supercharger. A transmission may be included in the supercharger to cause the supercharger rotors to turn at a step-up ratio of the pulley/input shaft speed. Examples of the planetary gear transmission of the present disclosure may allow higher step-up ratios in a more compact package than presently available supercharger transmissions.

Figure 1:
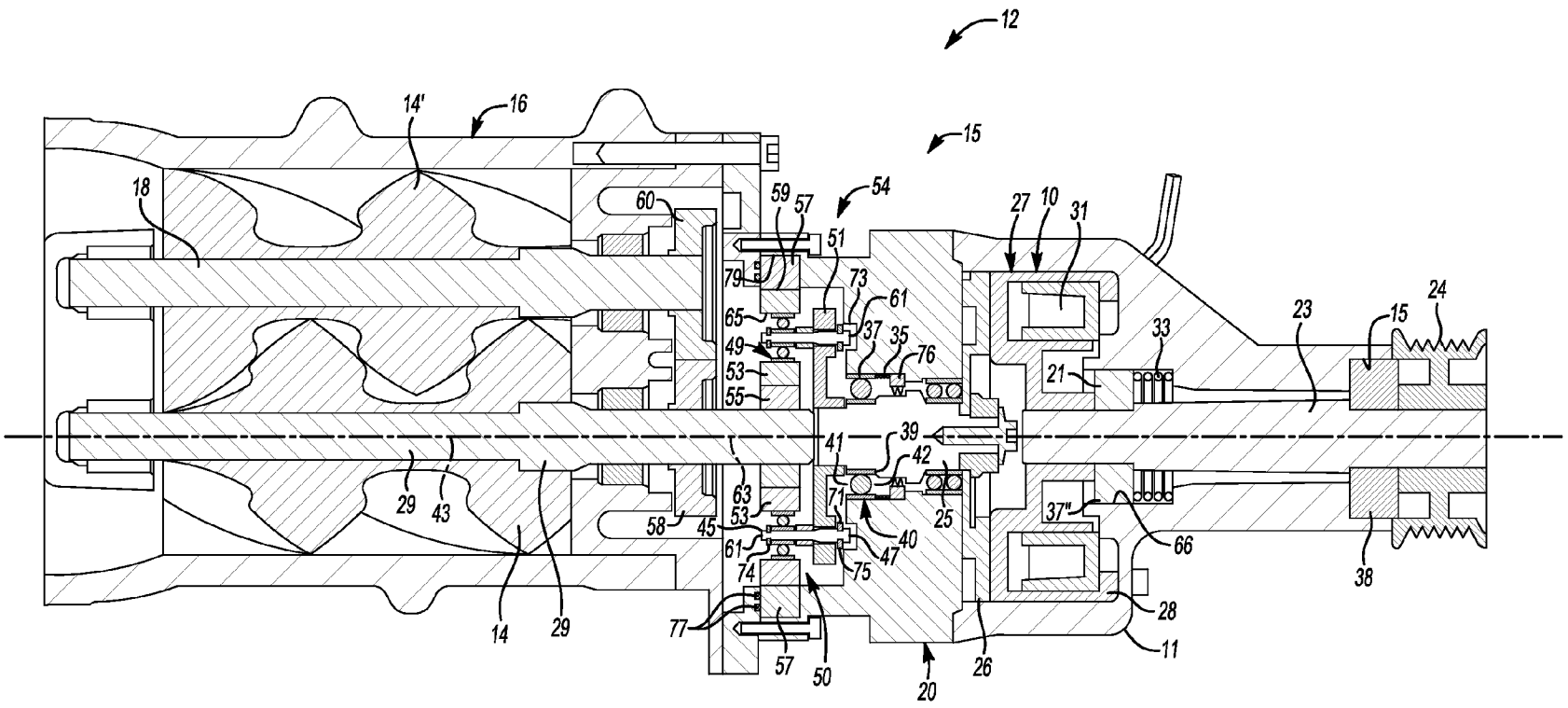
FIG. 1 is a semi-schematic cross-section view of an example of a supercharger with a planetary gearset and an electromagnetic clutch according to the present disclosure.

With reference to FIG. 1, a supercharger may include a primary supercharger rotor shaft 29 as the output of a supercharger transmission 54. The supercharger transmission 54 may have a gearing arrangement to step-up the speed of the primary supercharger rotor 14 and the secondary supercharger rotor 14' and thereby increase the airflow output of the supercharger 12.

The supercharger 12 may be powered by a belt-driven drive pulley 24. The drive pulley 24 may be driven by an engine crankshaft pulley (not shown) connected to the drive pulley 24 via a front end accessory drive (FEAD) belt (also not shown). In an example according to the present disclosure, the rotatable supercharger pulley driveshaft 23 may be driven in any suitable manner, for example by a chain drive (not shown). The drive pulley 24 may be fixed for rotation with a rotatable supercharger pulley driveshaft 23. Therefore, the rotatable supercharger pulley driveshaft 23 may be connectable to receive rotational motion and power from a motor (not shown). The motor may be an internal combustion engine, an electric motor, or combinations thereof. It is to be understood that the motor that powers the supercharger 12 is not necessarily the same internal combustion engine that receives air driven by the supercharger 12.

The drive pulley 24 is connected to the rotatable supercharger pulley driveshaft 23 of the supercharger 12. The rotatable supercharger pulley driveshaft 23 may be connected to a carrier driveshaft 25 to rotate a planetary gear carrier 51. A clutch assembly 10 may be disposed between the rotatable supercharger pulley driveshaft 23 and the carrier driveshaft 25. The clutch assembly 10 may selectively connect the rotatable supercharger pulley driveshaft 23 to the carrier driveshaft 25 for rotation therewith.

In examples of the present disclosure, the pulley driveshaft may rotate at a range of speeds up to about 10,000

RPM (revolutions per minute). When an internal combustion (IC) engine turns, the rotatable supercharger pulley driveshaft 23 may turn at a speed that depends on a ratio of the diameters of the crankshaft pulley (not shown) and the drive pulley 24. In an example, if the IC engine turns at about 1000 RPM, and the ratio of the crankshaft pulley diameter to the drive pulley diameter is about 2.5, then the rotatable supercharger pulley driveshaft 23 will turn at about 2500 RPM.

It may be desirable to turn the supercharger rotors 14, 14' at over 10,000 RPM to boost the power of the IC engine at low IC engine speeds. IC engines may turn over a wide range of speeds. For example, some captive two-stroke low speed diesel engines operate in a range from 100-200 RPM. Other diesel engines may operate in a range from about 500 RPM to about 2500 RPM. Some IC engines may operate from about 500 RPM to over 10,000 RPM.

In the example depicted in FIG. 1, the rotatable supercharger pulley driveshaft 23 is supported for rotation, at least in part, by an outer shaft bearing 38. In an example, the outer shaft bearing 38 may be a greased double-row ball bearing (e.g., not requiring access to a common sump of lubricant from within the supercharger housing 15, and, in some cases, lubed for the service life of the greased double-row ball bearing). The outer shaft bearing 38 may be disposed in a bore of the supercharger housing 15 near the drive pulley 24. In an example, the drive pulley 24 may surround a portion of the outer shaft bearing 38. An oil seal 76 may be disposed in the transmission housing 20 around the carrier driveshaft 25 on a portion of the carrier driveshaft 25 near an interface between the transmission housing 20 and the clutch housing 11. The oil seal 76 may be, for example, a double lip shaft seal, or a single lip shaft seal that allows the carrier driveshaft 25 to turn while substantially preventing oil from flowing between the interface of the carrier driveshaft and the oil seal 76. The oil seal 76 may retain lubricant substantially within the transmission housing 20 to allow for a common sump of lubrication for various internal components of the supercharger 12 and may provide a barrier to keep external contaminants outside of the common sump.

As depicted in FIG. 1, the rotatable supercharger pulley driveshaft 23 may also be supported by a deep-groove ball bearing 21. In an example of the present disclosure, the deep-groove ball bearing 21 and the outer shaft bearing 38 may be separated as much as possible along the rotatable supercharger pulley driveshaft 23. The deep-groove ball bearing 21 may be pressed on the rotatable supercharger pulley driveshaft 23 and disposed within the clutch housing 11 to float within a bearing bore 66 adjacent to clutch assembly 10. The bearing bore 66 may be sized to have a slip fit with the deep-groove ball bearing 21. A spring 33 may be disposed surrounding the rotatable supercharger pulley driveshaft 23 and between the clutch housing 11 and the deep-groove ball bearing 21 to place a light axial load on an outer race 37" of the deep-groove ball bearing 21 and prevent the outer race 37" from spinning in the bearing bore 66. The spring 33 may include, for example, a helical spring, a wave spring, a Belleville washer, an O-ring, and combinations thereof.

An example of an assembly method for the rotatable supercharger pulley driveshaft 23 according to the present disclosure includes the following: 1) pressing the deep-groove ball bearing 21 onto the rotatable supercharger pulley driveshaft 23; 2) pressing the outer shaft bearing 38 into the supercharger housing 15; 3) inserting spring 33 into the supercharger housing 15; and 4) pressing the rotatable supercharger pulley driveshaft 23 (with the deep-groove ball bearing installed thereon) into the outer shaft bearing 38 while supporting the inner race (not shown) of the outer shaft bearing 38. The foregoing disclosed method may reduce bearing damage during assembly.

The clutch assembly 10 may selectively connect the rotatable supercharger pulley driveshaft 23 to the carrier driveshaft 25 for rotation therewith. It is to be understood that the clutch assembly 10 may allow the rotatable supercharger pulley driveshaft 23 and the carrier driveshaft 25 to be selectively rotationally disconnected. Further, the clutch assembly 10 may allow rotational slippage between the rotatable supercharger pulley driveshaft 23 and the carrier driveshaft 25 for a time during engagement of the clutch 10 before the clutch 10 reaches full engagement. When the clutch 10 is fully engaged, the rotatable supercharger pulley driveshaft 23 and the carrier driveshaft 25 substantially rotate together without rotational slippage.

The clutch assembly 10 may include any type of clutch. For example, the clutch assembly 10 may be pneumatically actuated (not shown), hydraulically actuated (not shown), or electrically actuated (FIG. 1). The clutch assembly 10 may include a single plate friction clutch (FIG. 1), multiple plate friction clutch (not shown), or a dog clutch (not shown), etc. In an example, the clutch assembly 10 may include an electromagnetically actuated friction clutch 27 having an electromagnetic coil 31, a clutch armature 26, and a clutch rotor 28. The clutch rotor 28 may be attached to the rotatable supercharger pulley driveshaft 23 to rotate therewith. The clutch armature 26 may be attached to the carrier driveshaft 25 to rotate therewith. In another example (not shown) the clutch rotor 28 may be attached to the carrier driveshaft 25 to rotate therewith, and the clutch armature 26 may be attached to the pulley driveshaft. This example (not shown) may reduce the rotating inertia of the portion of the supercharger that is not arranged to be decoupled from the rotatable supercharger pulley driveshaft 23.

In the example depicted in FIG. 1, the electromagnetically actuated friction clutch 27 is biased to a normally disengaged configuration. Normally disengaged, as used herein, means that the clutch rotor 28 and the clutch armature 26 are in contact to rotate together when the electromagnetic coil 31 is energized by passing electric current through the electromagnetic coil 31. Otherwise, when no electric current passes through the electromagnetic coil 31, the clutch rotor 28 and the clutch armature 26 are not in contact and do not rotate together. Actuation of the electromagnetically actuated friction clutch 27 is caused by energizing the electromagnetic coil 31 to cause engagement or disengagement of opposing friction surfaces in the clutch mechanism (for example on opposed surfaces of the clutch rotor 28 and the clutch armature 26).

In the example depicted in FIG. 1, the clutch armature 26 may be magnetically attracted to the clutch rotor 28 when the electromagnetic coil 31 is energized, and the clutch armature 26 may be normally biased away from the clutch rotor 28 by a spring (not shown). For example, a plurality of leaf springs within the clutch armature 26 may be disposed to return the clutch armature 26 to a disengaged position when the electromagnetic coil 31 is not energized.

As depicted in FIG. 1, the carrier driveshaft 25 may be supported by a carrier shaft bearing 40. The carrier shaft bearing 40 may be located within the transmission housing 20 adjacent to the planetary gear carrier 51 (discussed further below). The carrier shaft bearing 40 may have an inner bearing end 41 proximate the planetary gear carrier 51 and an outer bearing end 42 distal to the planetary gear carrier 51. The carrier shaft bearing 40 may be disposed on the carrier driveshaft 25 against a shoulder 39 formed on the carrier driveshaft 25 to act as an axial stop for axially retaining the outer bearing end 42. A resilient annular element 35 may be disposed surrounding the carrier driveshaft 25 and between the outer bearing end 42 of an outer race 37 of carrier shaft bearing 40 and the oil seal 76 to provide a small amount of axial force to prevent the outer race 37 of the carrier shaft bearing 40 from rotating relative to the transmission housing 20. It is believed that by using the resilient annular element 35 as disclosed herein, damage to the carrier shaft bearing 40 may be avoided. The resilient annular element 35 may be, for example, a helical spring, a wave spring, a Belleville washer, O-rings, etc.

The resilient annular element 35 and carrier shaft bearing 40 arrangement disclosed above may improve durability of the carrier shaft bearing 40 in at least two ways: 1) compensating for the ratio of thermal expansion between an aluminum housing and the steel shaft contained within; and 2) avoiding pressing loads across the bearing that may cause brinelling of the bearing race. The thermal expansion ratio difference between the shaft and bearings and the aluminum housing in which they are contained may generate axial loads under thermal cycling that may reduce bearing life if both ends of the shaft are constrained by having both inner and outer bearing races installed by pressing.

In an example of the present disclosure, the carrier driveshaft 25 may be connectable to a planetary gearset 50. The planetary gearset 50 serves to turn the supercharger rotors 14, 14' at a step-up ratio applied to the speed of the carrier driveshaft 25. The planetary gearset 50 includes a plurality of planetary gears 53, a sun gear 55, and a ring gear 57. The ring gear 57 has internal teeth 59 and surrounds the planetary gears 53 in meshing engagement with each of the planetary gears 53 simultaneously. The sun gear 55 is in meshing engagement with each of the planetary gears 53 simultaneously, and the sun gear 55 is fixed to the primary supercharger rotor shaft 29 for rotation therewith.

The planetary gears 53 are substantially equally spaced about the sun gear 55. In examples of the present disclosure, the plurality of planetary gears 53 may include 3 planetary gears 53 or 5 planetary gears 53. In other examples, the planetary gears may include any number of planetary gears 53, for example 4 or 6 planetary gears 53. The planetary gears 53 are configured to revolve around the axis 43 of the sun gear 55 with the planetary gear carrier 51 via a plurality of planetary gear shafts 61 disposed thereon. The planetary gear shafts 61 each are substantially parallel to a carrier primary axis of rotation 63 which is substantially coincident with an axis of rotation of the carrier driveshaft 25 and the axis 43 of the sun gear 55. The planetary gears 53 include a plurality of gear bores 65 axially defined respectively within the plurality of planetary gears 53. Further, there may be a plurality of planetary roller bearings 49 respectively disposed within the plurality of planetary gear bores 65 for the planetary roller bearings 49 to support the plurality of planetary gear shafts 61. In other words, each gear bore 65 has a corresponding planetary roller bearing 49 for a respective corresponding planetary gear shaft 61. As such, each of the plurality of planetary gears 53 may rotate about a corresponding planetary gear shaft 61 of the plurality of planetary gear shafts.

It is to be understood that the gears of the planetary gearset 50, including the ring gear 57, sun gear 55, and planetary gears 53, may be sized according to particular application loading conditions. For example, the ring gear 57 may maximize the strength density of the transmission package volume by substantially matching the outer diameter of the clutch. In an example, the ring gear 57 may have an outer diameter of about 100 mm. In examples of the present disclosure, the planetary gears may have 24 teeth, on a diameter of 60 mm centers, and a pitch diameter of about 30 mm. In an example, the internal teeth 59 of the ring gear 57 may be helical gear teeth, and the sun gear 55 and the plurality of planetary gears 53 each have helical teeth to engage the internal teeth 59 of the ring gear 57. In an example of the present disclosure, the planetary gears 53 may be plastic, steel or combinations thereof.

The planetary gearset 50 may include a plurality of spacers 67 (see FIGS. 2 and 3) respectively disposed on the plurality of planetary gear shafts 61 between the plurality of planetary roller bearings 49 and the planetary gear carrier 51. The spacers 67 may improve interchangeability between parts. The spacers 67 may establish the value of the relative distance between the planetary gear 53 and the planetary gear carrier 51. Each of the planetary gear shafts 61 includes an annular bearing retention groove 69 on a bearing end 45 of each of the planetary gear shafts 61 and an annular carrier retention groove 71 defined on a carrier end 47 of each of the planetary gear shafts 61. The carrier end 47 of each planetary gear shaft 61 is distal to the bearing end 45. A first clip ring 74 may be disposed in the annular bearing retention groove 69 and a second clip ring 75 may be disposed in the annular carrier retention groove 71. At least one of the first clip ring 74 and the second clip ring 75 may be a bevel clip ring 88. (See FIG. 4A and 4B.)

It is to be understood that the supercharger housing 15 may include a rotor housing 16 that is separable from a transmission housing 20. The supercharger housing 15 may be joined together with bolts or other fasteners. A resilient gasket or other form of sealer may be disposed between portions of the supercharger housing to form a seal. For example, the primary supercharger rotor 14 may be disposed within the supercharger housing 15. The primary supercharger rotor 14 may be substantially, if not entirely, contained within the rotor housing 16 (i.e., the rotor may extend beyond the rotor housing 16 into the transmission housing 20 portion of the supercharger housing 15).

In an example, the transmission housing 20 may define an annular shaft clearance groove 73 for accommodating travel of the plurality of planetary gear shafts 61.

The ring gear 57 may be fixedly attached to the supercharger housing 15. In an example, the ring gear 57 may be clamped in series or parallel with a resilient ring 77 disposed between the rotor housing 16 and the transmission housing 20. The resilient ring 77 may provide a substantially liquid-tight seal between the ring gear 57 and the rotor housing 16. Clamping the ring gear 57 between the rotor housing 16 and the transmission housing 20 substantially prevents motion between the ring gear 57 and the supercharger housing 15. The resilient ring 77 provides a substantially uniform clamping load on the ring gear 57. The uniformity of the clamping load may reduce noise from cyclical inconsistencies of the planetary gears 53 engaging with the ring gear 57. The resilience of the resilient ring 77 further serves to damp vibration.

Figure 2:
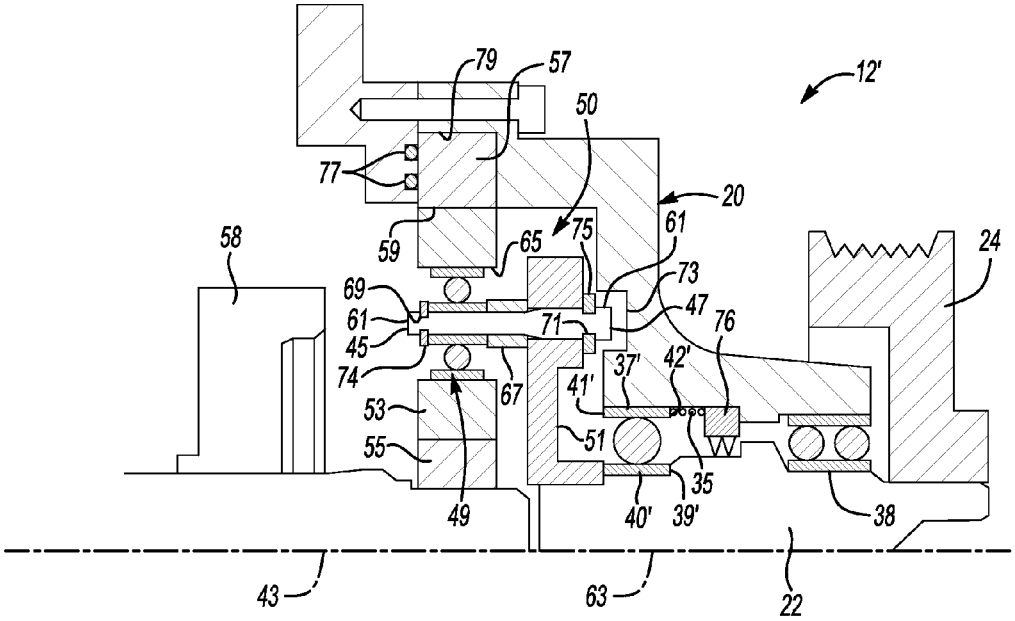
FIG. 2 is a semi-schematic cross-section view of a portion of an example of a supercharger with a planetary gearset similar to the supercharger of FIG. 1 without a clutch between the drive pulley and the planetary gearset according to the present disclosure.

As shown in FIG. 1 and FIG. 2, the transmission housing 20 may have a piloting diameter 79 for the ring gear 57.

In an example, the ring gear 57 is not clamped to the transmission housing 20 and is free to rotate relative to the supercharger housing 15 (not shown). In such an example, the ring gear 57 may be driven by an alternate power device (e.g., electric drive motors) to provide further modification of the gear ratios in the transmission by increasing or decreasing the relative speed of the ring gear 57. Examples of the present disclosure with a moving ring gear 57 may generate a range of ratios from about 20:1 to about 0.5:1. In this way, the supercharger may have a variable step-up ratio.

In an example of the present disclosure, the primary supercharger rotor 14 is fixed to a primary supercharger rotor shaft 29 for rotation therewith. The primary supercharger rotor 14 and a secondary supercharger rotor 14' are cooperatively driven through a pair of timing gears 58, 60, discussed more fully below. The primary supercharger rotor shaft 29 is fixed for rotation with the primary supercharger rotor 14 and a primary timing gear 58. The primary timing gear 58 is meshingly engaged with a secondary timing gear 60. The secondary timing gear 60 is fixed for rotation with a secondary rotor shaft 18. The secondary rotor shaft 18 is also fixed for rotation with the secondary rotor 14'. The secondary rotor 14' cooperatively rotates with a controlled position relative to the primary supercharger rotor 14 with substantially no contact therebetween. An abradeable powdercoat on the rotors 14, 14' may compensate for manufacturing tolerances. The timing gears 58, 60 may include an equal number of gear teeth spaced at a relatively high tooth pitch. For example, the timing gears 58, 60 may each have 30 teeth for meshing engagement with one another, therefore the timing gears 58, 60 rotate with a substantially equal angular speed. As such, the timing gears 58, 60 substantially synchronize the rotors 14, 14', thereby substantially preventing contact between the lobes of the rotors 14, 14'. A small amount of flank-to-flank lash may be split between rotors to compensate for thermal and pressure induced distortion of rotor size, shape, and position.

FIG. 2 is a semi-schematic cross-section view of a portion of an example of a supercharger 12' with a planetary gearset 50 similar to the supercharger 12 of FIG. 1 without a clutch assembly between the drive pulley 24 and the planetary gearset 50 according to the present disclosure. Many of the elements of the supercharger 12' depicted in FIG. 2 are the same as the elements in FIG. 1. In FIG. 2, however, a rotatable input shaft 22 is a combination of the rotatable supercharger pulley driveshaft 23 and the carrier driveshaft 25 depicted in FIG. 1.

In the example depicted in FIG. 2, the rotatable input shaft 22 is supported for rotation, at least in part, by an outer shaft bearing 38 similar to the outer shaft bearing 38 in FIG. 1. An oil seal 76 may be disposed in the transmission housing 20 around the rotatable input shaft 22 on a portion of the rotatable input shaft 22 near the outer shaft bearing 38. The oil seal 76 may be, for example, a double lip shaft seal, or a single lip shaft seal that allows the rotatable input shaft 22 to turn while substantially preventing oil from flowing between the interface of the rotatable input shaft 22 and the oil seal 76. The oil seal 76 may retain lubricant substantially within the transmission housing 20 to allow for a common sump of lubrication for various internal components of the supercharger 12' and may provide a barrier to keep external contaminants outside of the common sump.

As depicted in FIG. 2, the rotatable input shaft 22 may be supported by a carrier shaft bearing 40'. The carrier shaft bearing 40' may be located within the transmission housing 20 adjacent to the planetary gear carrier 51. The carrier shaft bearing 40' may have an inner bearing end 41' proximate the planetary gear carrier 51 and an outer bearing end 42' distal to the planetary gear carrier 51. The carrier shaft bearing 40' may be disposed on the rotatable input shaft 22 against a shoulder 39' formed on the rotatable input shaft 22 to act as an axial stop for axially retaining the outer bearing end 42'.

A resilient annular element 35 may be disposed surrounding the rotatable input shaft 22 and between the outer bearing end 42' of an outer race 37' of carrier shaft bearing 40' and the oil seal 76 to provide a small amount of axial force to prevent the outer race 37' of the carrier shaft bearing 40' from rotating relative to the transmission housing 20. It is believed that by using the resilient annular element 35 as disclosed herein, damage to the carrier shaft bearing 40' (such as brinelling that could occur from pressing the bearing into the transmission housing 20 by applying a pressing force to the rotatable input shaft 22) may be avoided. Further, the disclosed arrangement may reduce side loading of the bearing during thermal expansion of the aluminum housing and steel rotatable input shaft 22. Without the arrangement including the resilient annular element 35, the difference between the thermal expansion rates may cause excessive translation of the related bearing race positions. For example, if the bearing were pressed on both the inner and outer races, the housing could expand in diameter thereby reducing retention force on the bearing. The housing could also expand in length—enabling the bearing to shift in position in the thermally expanded bore. Subsequently, the housing may cool and re-retain the bearing in an incorrect position. The resilient annular element 35 may be, for example, a helical spring, a wave spring, a Belleville washer, O-rings, etc.

Figure 3:
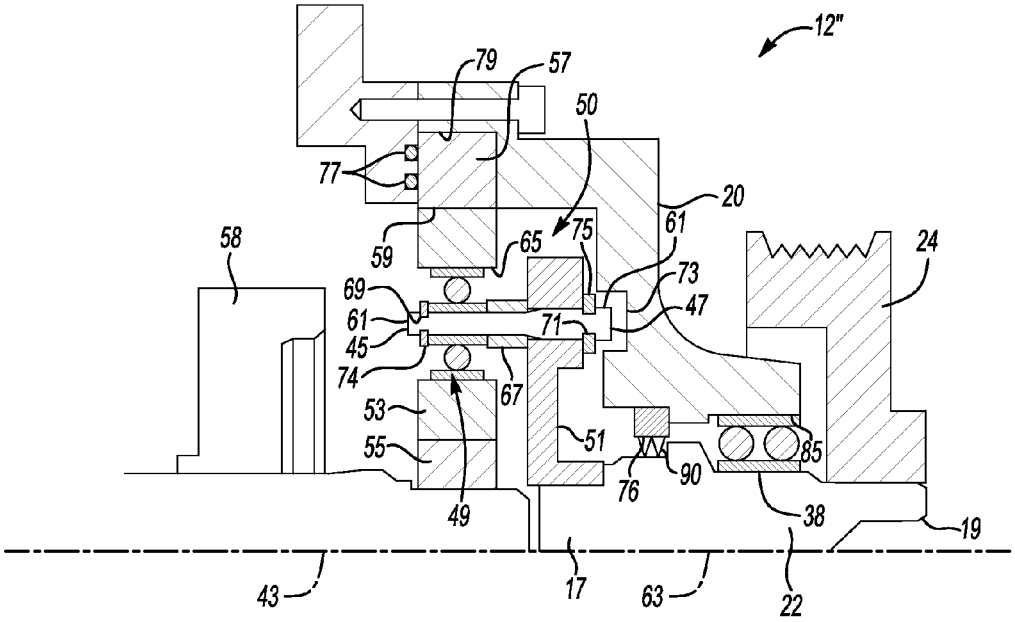
FIG. 3 is a semi-schematic cross-section view of a portion of an example of a supercharger with a planetary gearset similar to the supercharger depicted in FIG. 2 without the carrier shaft bearing according to the present disclosure.

FIG. 3 is a semi-schematic cross-section view of a portion of an example of a supercharger 12" with a planetary gearset 50 similar to the supercharger 12' of FIG. 2 without the carrier shaft bearing 40' depicted in FIG. 2. In the example depicted in FIG. 3, the rotatable input shaft 22 is supported near a pulley end 19 of the rotatable input shaft 22 by the outer shaft bearing 38 disposed in a bore 85 of the transmission housing 20, and the rotatable input shaft 22 is supported on a planetary end 17 of the rotatable input shaft 22 distal to the pulley end 19 by the planetary gear carrier 51 without a bearing supporting the rotatable input shaft 22 between the planetary gear carrier 51 and the outer shaft bearing 38. Thus, the planetary gearset 50 may function as a bearing support for the rotatable input shaft 22. In this way, the rotatable input shaft 22 receives sufficient support from the planetary gears 53 through the planetary gear shafts 61 in order to omit the carrier shaft bearing 40' that was included in the example depicted in FIG. 2. As such, in the example depicted in FIG. 3, the outer shaft bearing 38 is the only bearing directly on the rotatable input shaft 22. It is to be understood that oil seal 76 substantially does not contribute to support of the rotatable input shaft 22 because of the flexibility of the resilient portions 90. As such, an oil seal 76 with resilient portions 90 that are the only contact between the oil seal 76 and the rotatable input shaft 22 is not to be considered a bearing as used herein. The supercharger 12" may weigh less, and have a shorter length than the supercharger 12' because the carrier shaft bearing 40' depicted in FIG. 2 has been removed from the supercharger 12" depicted in FIG. 3.

Figure 4A:
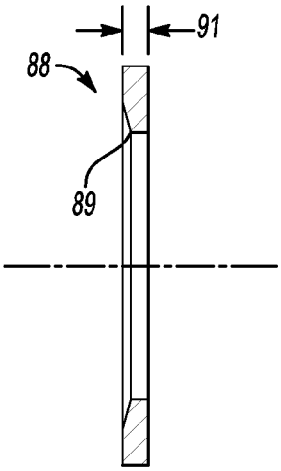
FIG. 4A is a cross-section view of an example of a bevel clip ring according to the present disclosure.
Figure 4B:
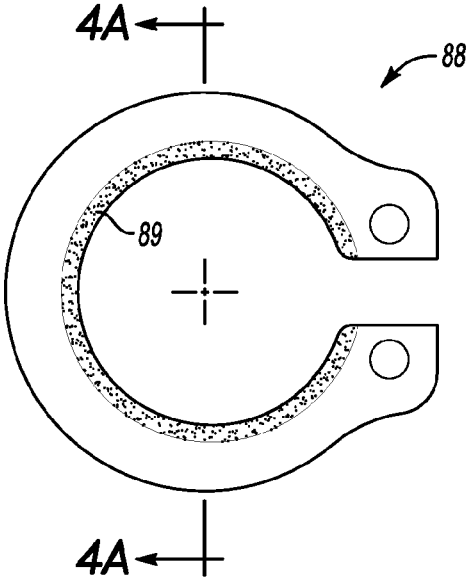
FIG. 4B is a top view of the example of the bevel clip ring depicted in FIG. 4A.

FIG. 4A is a cross-section view of an example of a bevel clip ring 88 according to the present disclosure. The bevel clip ring 88 is distinguished from other clip rings by the beveled inner diameter 89. The beveled inner diameter 89 cooperates with the annular bearing retention groove 69 and/or the annular carrier retention groove 71 to reduce axial motion of the planetary gears 53 along the planetary gear shaft 61. A thickness 91 of the bevel clip ring 88 may be larger than the annular bearing/carrier retention groove 69/71. As such, the beveled inner diameter 89 may act as a wedge, eliminating play between the bevel clip ring 88 and the planetary gear shaft 61.

Figure 5:
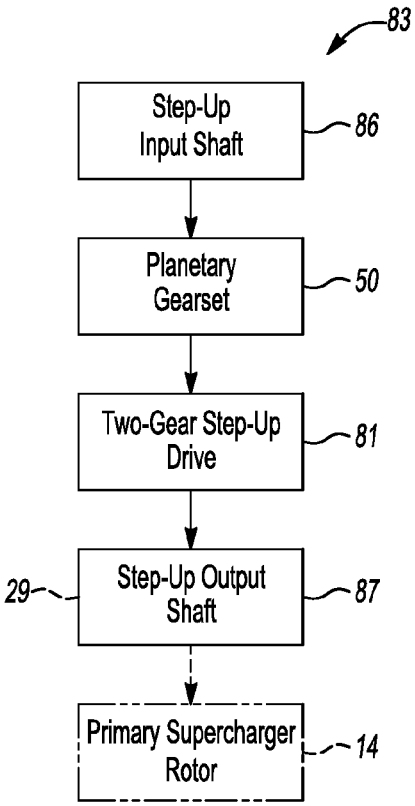
FIG. 5 is a block diagram depicting an example of a combination transmission according to the present disclosure.

A range of transmission gear ratios, i.e., step-up gear ratios, from about 2:1 to about 6:1 may be used in examples of the present disclosure. As shown in FIG. 5, a two-gear step-up drive 81 may be used in addition to the planetary gearset 50 as described above to provide a combination transmission 83 for the supercharger. In this way, the output of the planetary gearset 50 drives one of the gears of the two-gear step-up drive 81 to provide a cumulative gear ratio. The drive ratio of combination transmission 83 provides a rotational speed differential between a step-up input shaft 86 and a step-up output shaft 87. For example, if using a 2:1 step-up gear ratio, when the step-up input shaft 86 spins at 1,000 revolutions per minute (RPM), the primary supercharger rotor 14 may spin at 2,000 RPM because the primary supercharger rotor 14 rotates with the step-up output shaft 87. The step-up output shaft 87 may be the primary supercharger rotor shaft 29. The combination transmission 83 also allows for packaging flexibility by allowing the input shaft centerline to be located in any angular position about the pitch diameter interface of the step-up gears—even if a 1:1 ratio is selected.

It is to be understood that the terms "connect/connected/connection" and/or the like are broadly defined herein to encompass a variety of divergent connected arrangements and assembly techniques. These arrangements and techniques include, but are not limited to (1) the direct communication between one component and another component with no intervening components therebetween; and (2) the communication of one component and another component with one or more components therebetween, provided that the one component being "connected to" the other component is somehow in operative communication with the other component (notwithstanding the presence of one or more additional components therebetween).

In describing and claiming the examples disclosed herein, the singular forms "a", "an", and "the" include plural referents unless the context clearly dictates otherwise.

It is to be understood that the ranges provided herein include the stated range and any value or sub-range within the stated range. For example, a range from about 500 RPM to about 2500 RPM should be interpreted to include not only the explicitly recited limits of about 500 RPM to about 2500 RPM, but also to include individual values, such as 550 RPM, 820 RPM, 1200 RPM etc., and sub-ranges, such as from about 750 RPM to about 1000 RPM, etc. Furthermore, when "about" is utilized to describe a value, this is meant to encompass minor variations (up to +/−10%) from the stated value.

Furthermore, the terms "first," "second," and the like herein do not denote any order, quantity, or importance, but rather are used to distinguish one element from another. Reference throughout the specification to "one example", "another example", "an example", and so forth, means that a particular element (e.g., feature, structure, and/or characteristic) described in connection with the example is included in at least one example described herein, and may or may not be present in other examples. In addition, it is to be understood that the described elements for any example may be combined in any suitable manner in the various examples unless the context clearly dictates otherwise.

While several examples have been described in detail, it will be apparent to those skilled in the art that the disclosed examples may be modified. Therefore, the foregoing description is to be considered non-limiting.

What is claimed is:

1. A supercharger, comprising:

a supercharger housing;

a primary supercharger rotor disposed within the supercharger housing, the primary supercharger rotor having a primary supercharger rotor shaft fixed thereto to rotate therewith;

a ring gear fixedly attached to a transmission housing portion of the supercharger housing wherein the ring gear has internal teeth;

a sun gear fixed to the primary supercharger rotor shaft to rotate therewith;

a planetary gear carrier having a plurality of planetary gear shafts disposed thereon, the plurality of planetary gear shafts each being substantially parallel to a carrier primary axis of rotation;

a plurality of planetary gears meshingly engaged with the sun gear and the ring gear, the plurality of planetary gears substantially equally spaced about the sun gear, each of the plurality of planetary gears to rotate about a corresponding planetary gear shaft of the plurality of planetary gear shafts; and a rotatable input shaft connectable to the planetary gear carrier, wherein:

the rotatable input shaft is connectable to receive rotational motion and power from a motor;

the transmission housing defines an annular shaft clearance groove for accommodating travel of the plurality of planetary gear shafts; and the ring gear is clamped with a resilient ring between a rotor housing and the transmission housing.

2. The supercharger as defined in claim 1 wherein the rotatable input shaft is directly connected to the planetary gear carrier to rotate therewith.

3. The supercharger as defined in claim 1, further comprising:

a bearing proximate the planetary gear carrier to support the rotatable input shaft, the bearing having:

an inner bearing end proximate the planetary gear carrier; and an outer bearing end distal to the planetary gear carrier; and a bearing-contacting resilient annular element axially disposed between the bearing end distal to the planetary gear carrier and a shoulder of the transmission housing.

4. The supercharger as defined in claim 1, further comprising:

a plurality of planetary gear bores axially defined respectively within the plurality of planetary gears;

a plurality of roller bearings respectively disposed within the plurality of planetary gear bores, the plurality of roller bearings to support the plurality of planetary gear shafts;

a plurality of spacers respectively disposed on the plurality of planetary gear shafts between the plurality of roller bearings and the planetary gear carrier;

an annular bearing retention groove defined on a bearing end of each of the planetary gear shafts of the plurality of planetary gear shafts;

an annular carrier retention groove defined on a carrier end of each of the planetary gear shafts of the plurality of planetary gear shafts, the carrier end distal to the bearing end; and a first clip ring in the annular bearing retention groove and a second clip ring in the annular carrier retention groove, wherein at least one of the first and second clip rings is a bevel clip ring.

5. The supercharger as defined in claim 1 wherein:

the primary supercharger rotor shaft is fixed for rotation with a primary timing gear;

the primary timing gear is meshingly engaged with a secondary timing gear;

the secondary timing gear is fixed for rotation with a secondary rotor shaft;

the secondary rotor shaft is fixed for rotation with a secondary rotor; and the secondary rotor is operable to rotate with a controlled position relative to the primary supercharger rotor with substantially no contact therebetween.

6. The supercharger as defined in claim 1 wherein the plurality of planetary gears includes 3 planetary gears or 5 planetary gears.

7. The supercharger as defined in claim 1 wherein the supercharger includes a step-up gear ratio ranging from about 2:1 to about 6:1.

8. The supercharger as defined in claim 1 wherein the internal teeth of the ring gear are helical gear teeth, and wherein the sun gear and the plurality of planetary gears each have helical gear teeth.

9. The supercharger as defined in claim 1, further comprising a clutch assembly disposed between the rotatable input shaft and the planetary gear carrier to selectively connect the rotatable input shaft to the planetary gear carrier.

10. A supercharger, comprising:

a supercharger housing;

a ring gear fixedly attached to a transmission housing portion of the supercharger housing wherein the ring gear has internal teeth;

a sun gear fixed to a primary supercharger rotor shaft to rotate therewith a planetary gear carrier having a plurality of planetary gear shafts disposed thereon, the plurality of planetary gear shafts each being substantially parallel to a carrier primary axis of rotation;

a plurality of planetary gears meshingly engaged with the sun gear and the ring gear, the plurality of planetary gears substantially equally spaced about the sun gear, each of the plurality of planetary gears to rotate about a corresponding planetary gear shaft of the plurality of planetary gear shafts, wherein the transmission housing defines an annular shaft clearance groove for accommodating travel of the plurality of planetary gear shafts;

a rotatable input shaft connectable to the planetary gear carrier, wherein the rotatable input shaft is connectable to receive rotational motion and power from a motor; and a planetary gearset, including:

a plurality of gear bores axially defined respectively within the plurality of planetary gears;

a plurality of roller bearings respectively disposed within the plurality of planetary gear bores, the plurality of roller bearings to support the plurality of planetary gear shafts;

a plurality of spacers respectively disposed on the plurality of planetary gear shafts between the plurality of roller bearings and the planetary gear carrier.

11. The supercharger as defined in claim 10 wherein:

the primary supercharger rotor shaft is fixed for rotation with a primary timing gear;

the primary timing gear is meshingly engaged with a secondary timing gear;

the secondary timing gear is fixed for rotation with a secondary rotor shaft;

the secondary rotor shaft is fixed for rotation with a secondary rotor; and the secondary rotor is operable to rotate with a controlled position relative to the primary supercharger rotor with substantially no contact therebetween.

12. The supercharger as defined in claim 10 wherein the rotatable input shaft is supported near a pulley end of the rotatable input shaft by an outer shaft bearing disposed in a bore of the transmission housing portion of the supercharging housing and the rotatable input shaft is supported on a planetary end of the rotatable input shaft distal to the pulley end by the planetary gear carrier without a bearing supporting the rotatable input shaft between the planetary gear carrier and the outer shaft bearing.

13. The supercharger as defined in claim 10 wherein the supercharger includes a transmission having a step-up gear ratio ranging from about 2:1 to about 6:1.

14. The supercharger as defined in claim 10 wherein the ring gear is clamped with a resilient ring between a rotor housing and the transmission housing portion of the supercharger housing.

15. A supercharger, comprising:

a supercharger housing;

a primary supercharger rotor disposed within the supercharger housing, the primary supercharger rotor having a primary supercharger rotor shaft fixed thereto to rotate therewith;

a planetary gear carrier having a plurality of planetary gear shafts disposed thereon, the planetary gear shafts each being substantially parallel to a carrier primary axis of rotation;

a ring gear fixedly attached to a transmission housing portion of the supercharger housing wherein:

the ring gear has internal teeth;

the internal teeth of the ring gear are helical gear teeth;

the transmission housing defines an annular shaft clearance groove for accommodating travel of the plurality of planetary gear shafts; and the ring gear is clamped with a resilient ring between a rotor housing and the transmission housing portion of the supercharger housing;

a sun gear fixed to the primary supercharger rotor shaft to rotate therewith;

a plurality of planetary gears meshingly engaged with the sun gear and the ring gear, the plurality of planetary gears substantially equally spaced about the sun gear, each of the plurality of planetary gears to rotate about a corresponding planetary gear shaft of the plurality of planetary gear shafts wherein the sun gear and the plurality of planetary gears each have helical gear teeth;

a rotatable input shaft connectable to the planetary gear carrier, wherein the rotatable input shaft is connectable to receive rotational motion and power from a motor; a bearing proximate the planetary gear carrier to support the rotatable input shaft, the bearing having:

an inner bearing end proximate the planetary gear carrier; and an outer bearing end distal to the planetary gear carrier;

a bearing-contacting resilient annular element axially disposed between the bearing end distal to the planetary gear carrier and a shoulder of the transmission housing;

a plurality of planetary gear bores axially defined respectively within the plurality of planetary gears;

a plurality of roller bearings respectively disposed within the plurality of planetary gear bores, the plurality of roller bearings to support the plurality of planetary gear shafts;

a plurality of spacers respectively disposed on the plurality of planetary gear shafts between the plurality of roller bearings and the planetary gear carrier;

an annular bearing retention groove defined on a bearing end of each of the planetary gear shafts of the plurality of planetary gear shafts;

an annular carrier retention groove defined on a carrier end of each of the planetary gear shafts of the plurality of planetary gear shafts, the carrier end distal to the bearing end;

a first clip ring in the annular bearing retention groove and a second clip ring in the annular carrier retention groove, wherein at least one of the first and second clip rings is a bevel clip ring; wherein:

the primary supercharger rotor shaft is fixed for rotation with a primary timing gear;

the primary timing gear is meshingly engaged with a secondary timing gear;

the secondary timing gear is fixed for rotation with a secondary rotor shaft;

the secondary rotor shaft is fixed for rotation with a secondary rotor;

the secondary rotor is operable to rotate with a controlled position relative to the primary supercharger rotor with substantially no contact therebetween;

the plurality of planetary gears includes 3 planetary gears or 5 planetary gears; and the supercharger includes a step-up gear ratio ranging from about 2:1 to about 6:1.

16. The supercharger as defined in claim 15 wherein the rotatable input shaft is directly connected to the planetary gear carrier to rotate therewith.

17. The supercharger as defined in claim 15, further comprising a clutch assembly disposed between the rotatable input shaft and the planetary gear carrier to selectively connect the rotatable input shaft to the planetary gear carrier.

18. A supercharger, comprising:

a supercharger housing;

a primary supercharger rotor disposed within the supercharger housing, the primary supercharger rotor having a primary supercharger rotor shaft fixed thereto to rotate therewith;

a ring gear fixedly attached to a transmission housing portion of the supercharger housing wherein the ring gear has internal teeth;

a sun gear fixed to the primary supercharger rotor shaft to rotate therewith;

a planetary gear carrier having a plurality of planetary gear shafts disposed thereon, the plurality of planetary gear shafts each being substantially parallel to a carrier primary axis of rotation;

a plurality of planetary gears meshingly engaged with the sun gear and the ring gear, the plurality of planetary gears substantially equally spaced about the sun gear, each of the plurality of planetary gears to rotate about a corresponding planetary gear shaft of the plurality of planetary gear shafts, wherein the transmission housing defines an annular shaft clearance groove for accommodating travel of the plurality of planetary gear shafts; and a rotatable input shaft connectable to the planetary gear carrier, wherein:

the rotatable input shaft is connectable to receive rotational motion and power from a motor; and the ring gear is clamped with a resilient ring between a rotor housing and the transmission housing portion of the supercharger housing.

19. The supercharger as defined in claim 18 wherein the rotatable input shaft is supported near a pulley end of the rotatable input shaft by an outer shaft bearing disposed in a bore of the transmission housing portion of the supercharger housing and the rotatable input shaft is supported on a planetary end of the rotatable input shaft distal to the pulley end by the planetary gear carrier without a bearing supporting the rotatable input shaft between the planetary gear carrier and the outer shaft bearing.

20. The supercharger as defined in claim 18, further comprising:

a plurality of planetary gear bores axially defined respectively within the plurality of planetary gears;

a plurality of roller bearings respectively disposed within the plurality of planetary gear bores, the plurality of roller bearings to support the plurality of planetary gear shafts; and a plurality of spacers respectively disposed on the plurality of planetary gear shafts between the plurality of roller bearings and the planetary gear carrier.

21. The supercharger as defined in claim 18 wherein:

the primary supercharger rotor shaft is fixed for rotation with a primary timing gear;

the primary timing gear is meshingly engaged with a secondary timing gear;

the secondary timing gear is fixed for rotation with a secondary rotor shaft;

the secondary rotor shaft is fixed for rotation with a secondary rotor; and the secondary rotor is operable to rotate with a controlled position relative to the primary supercharger rotor with substantially no contact therebetween.

22. A supercharger, comprising:

a supercharger housing;

a primary supercharger rotor disposed within the supercharger housing, the primary supercharger rotor having a primary supercharger rotor shaft fixed thereto to rotate therewith;

a sun gear fixed to the primary supercharger rotor shaft;

a planetary gear carrier having a plurality of planetary gear shafts disposed thereon, the plurality of planetary gear shafts each being substantially parallel to a carrier primary axis of rotation; and a ring gear fixedly attached to a transmission housing portion of the supercharger housing, wherein the ring gear has internal teeth; a plurality of planetary gears meshingly engaged with the sun gear and the ring gear, each of the plurality of planetary gears to rotate about a corresponding planetary gear shaft of the plurality of planetary gear shafts; and an annular shaft clearance groove defined by the transmission housing, the annular shaft clearance groove for accommodating travel of the plurality of planetary gear shafts.

23. The supercharger as defined in claim 22 wherein the ring gear is clamped with a resilient ring between a rotor housing and the transmission housing portion of the supercharger housing.

24. The supercharger as defined in claim 22, further comprising:

a plurality of planetary gear bores axially defined respectively within the plurality of planetary gears;

a plurality of roller bearings respectively disposed within the plurality of planetary gear bores, the plurality of roller bearings to support the plurality of planetary gear shafts; and a plurality of spacers respectively disposed on the plurality of planetary gear shafts between the plurality of roller bearings and the planetary gear carrier;

wherein:

the sun gear is to rotate with the primary supercharger rotor shaft; and the plurality of planetary gears are substantially equally spaced about the sun gear.

25. The supercharger as defined in claim 22, further comprising a rotatable input shaft connectable to the planetary gear carrier, wherein the rotatable input shaft is connectable to receive rotational motion and power from a motor, wherein the rotatable input shaft is supported near a pulley end of the rotatable input shaft by an outer shaft bearing disposed in a bore of the transmission housing portion of the supercharger housing and the rotatable input shaft is supported on a planetary end of the rotatable input shaft distal to the pulley end by the planetary gear carrier without a bearing supporting the rotatable input shaft between the planetary gear carrier and the outer shaft bearing.

26. The supercharger as defined in claim 22 wherein:

the primary supercharger rotor shaft is fixed for rotation with a primary timing gear;

the primary timing gear is meshingly engaged with a secondary timing gear;

the secondary timing gear is fixed for rotation with a secondary rotor shaft;

the secondary rotor shaft is fixed for rotation with a secondary rotor; and the secondary rotor is operable to rotate with a controlled position relative to the primary supercharger rotor with substantially no contact therebetween.

* * * * *